United States Patent [19]

Otto

[11] Patent Number: 4,669,661

[45] Date of Patent: Jun. 2, 1987

[54] PROCESS AND DEVICE FOR THE SPRAYING OF HOT MELT GLUE

[75] Inventor: Alfred R. Otto, Kleinostheim, Fed. Rep. of Germany

[73] Assignee: Beyer & Otto GmbH, Fed. Rep. of Germany

[21] Appl. No.: 679,703

[22] Filed: Dec. 10, 1984

[30] Foreign Application Priority Data

Mar. 1, 1984 [DE] Fed. Rep. of Germany ... 8406368[U]

[51] Int. Cl.[4] ..... B05B 1/24

[52] U.S. Cl. ..... 239/132.1; 239/133; 239/139; 239/406; 239/415; 239/528

[58] Field of Search ..... 239/8, 13, 132.1, 133, 239/134, 135, 139, 412, 406, 414, 415, 527, 528

[56] References Cited

U.S. PATENT DOCUMENTS

| | | | |
|---|---|---|---|
| 1,609,465 | 12/1926 | Day | 239/133 |
| 1,644,081 | 10/1927 | Preble | 239/133 |
| 1,792,551 | 2/1931 | Rice et al. | 239/135 |
| 2,266,365 | 12/1941 | Harrison et al. | 239/412 |
| 2,401,504 | 6/1946 | Paasche | 239/133 |
| 3,219,274 | 11/1965 | Roche | 239/13 |
| 3,776,462 | 12/1973 | Payne, Jr. | 239/135 |
| 4,056,707 | 11/1977 | Farnam | 239/135 |
| 4,260,873 | 4/1981 | Simmonds | 239/133 |
| 4,394,967 | 7/1983 | Amiaut | 239/133 |

*Primary Examiner*—Duane A. Reger
*Assistant Examiner*—Michael J. Forman
*Attorney, Agent, or Firm*—Jordan B. Bierman

[57] ABSTRACT

A process and a device (10) are proposed for spraying hot melt glue with which the heated hot melt glue by means of a pneumatically operated extrusion gun can be fed to a nozzle (25), to which pressurized air is supplied for spraying the glue. The pressurized air is heated up by means of a heating cartridge (14) around which the pressurized air is fed in spiral form. The heating cartridge (14) heats up the casing (12) of the extrusion gun simultaneously and controlled.

8 Claims, 3 Drawing Figures

PROCESS AND DEVICE FOR THE SPRAYING OF HOT MELT GLUE

Figure 1:
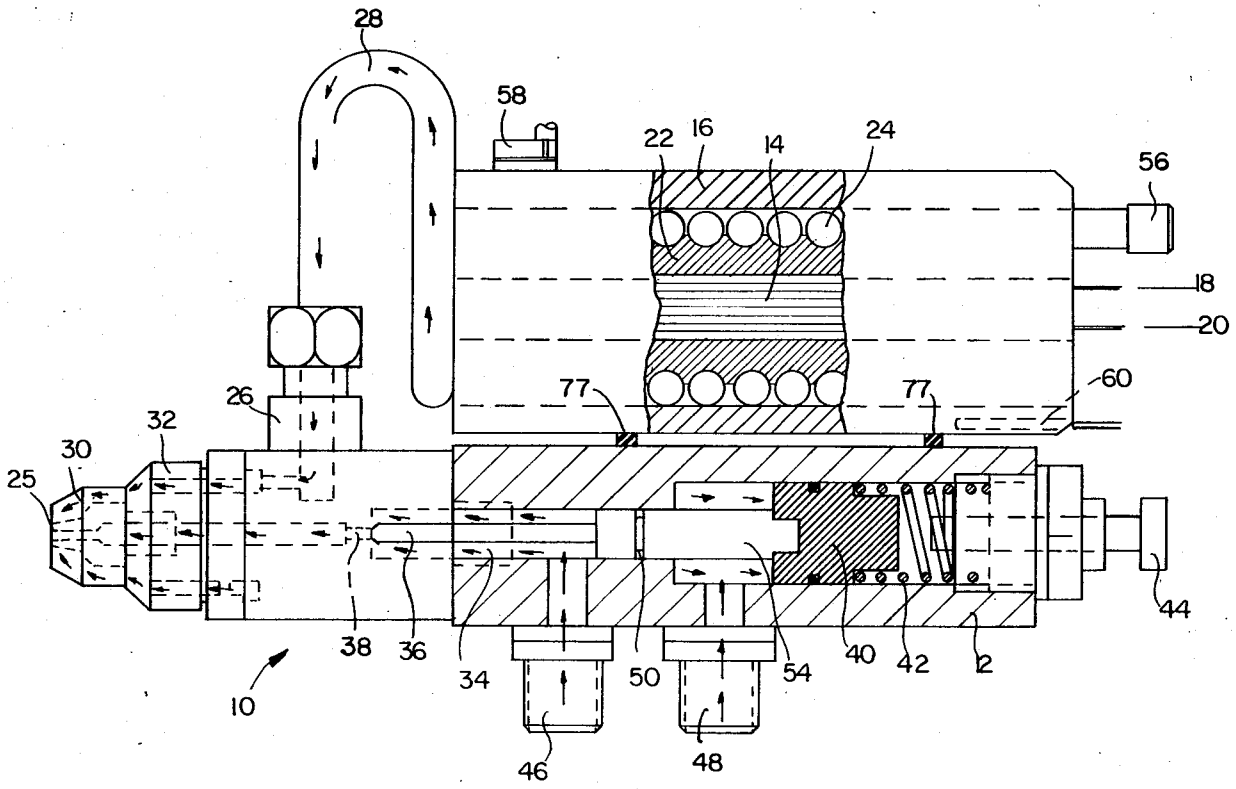

The invention is based on process and a device for spraying hot melt glue which in a melted state by means of a pneumatically powered extrusion gun having a certain temperature is directed to a valve to which heated air is supplied under pressure in order to spray the hot melt glue.

STATE OF THIS TECHNOLOGY

In the case of known devices for spraying hot melt glue the extrusion gun is heated up with the aid of a heat source so that the glue not be negatively influenced in its viscosity through loss of heat, which would make spraying difficult or impossible. The hot air necessary for spraying is heated up by a separate source of heat remote from the extrusion gun. In order to avoid unnecessary loss of heat between this second source of heat and the nozzle the supply line is insulated. However loss of energy can never be fully excluded so that the air often no longer has the necessary temperature when it reaches the nozzle. In particular when throughput is high it can be established that the air temperature at the nozzle is so low that the hot melt glue can no longer be sprayed. Hereby it must also be taken into consideration that the air surrenders heat during its transport through the nozzle area of the extrusion gun.

If several automatic extruders or manual extrusion guns are supplied from one source of compressed air then complex heating devices are necessary to heat up the required air volume to a sufficient extent, these being in addition to the heating sources required by which the extrusion housings of the automatic extruders or manual extrusion guns are heated up.

AIM OF THE INVENTION

The purpose of the invention is firstly to develop a process and device in the manner described at the beginning that it is certain that the air necessary for spraying possesses the required temperature without having to take extensive measures to provide heat sources and insulation. Another aim of the invention is to provide a device for the spraying of hot melt glue which though having a simple design allows for easy adjustment of the required temperature of the extrusion housing and the air required to be sprayed.

Finally it is an aim of the invention where extrusion guns or automatic extruders are arranged in batteries to heat up the air and the extrusion housing without having to adjust the required heat source for heating up the air to the number of automatic extruders or manual extrusion guns.

This task is solved mainly by a process which is distinguished by the fact that a single source of heat heats up the extrusion gun as well as the air to the required degree. Hereby primarily the air is heated to the required temperature by the source of heat, which in turn is fed into a tube in screw form around the source of heat. By means of an adjustable heat contact between gun housing and a housing accomodating the source of heat, the required degree of temperature of the gun housing can be adjusted.

Adjustment of the required temperature of the air for spraying takes place by taking into consideration during the heating process an energy loss of the air occurs when it is fed through the nozzle area of the extrusion gun.

The device for spraying the hot melt glue in detail a pneumatically powered extrusion gun with gun casing through which the hot melt glue can be fed to a nozzle, to which pressurised hot air can be fed for spraying hot melt glue, is distinguished by the gun casing being equipped with a heat source in a housing and that a tube for transporting the air is located around the heat source in spiral form, whereby a heat conducting connection exists between the housing and the gun casing. Hereby is the distance between the housing and the gun casing adjustable enabling controlled heating of the gun casing depending on the hot melt glue to be sprayed. This gives the advantage that the heating power of the preferably heating cartridge formed source of heat does not have to be altered.

The heating cartridge itself is surrounded by a preferably metal sheath formed hollow cylindrical element, in whose surface the tube carrying the air is located in spiral form. In order to facilitate a good heat exchange the outer surface of the sheath has a spiral shaped depression flute-shaped in which at least part of the tube can be embedded.

The device itself can be hand operated whereby the gun casing and the housing accomodating the source of heat are surrounded by a gun casing which has a manual grip. From this 3-way valve is actuated in order to direct compressed air via this to the extrusion gun as well as the tube around the heat source.

Further details, advantages and characteristics of the invention can be extracted from the following description, from illustrated examples of versions which however should not lead to a limitation of the innovative concept.

SHORT DESCRIPTION OF THE EXAMPLES OF VERSIONS

FIG. 1 a cross-section illustration of an automatic extruder.

Figure 2:
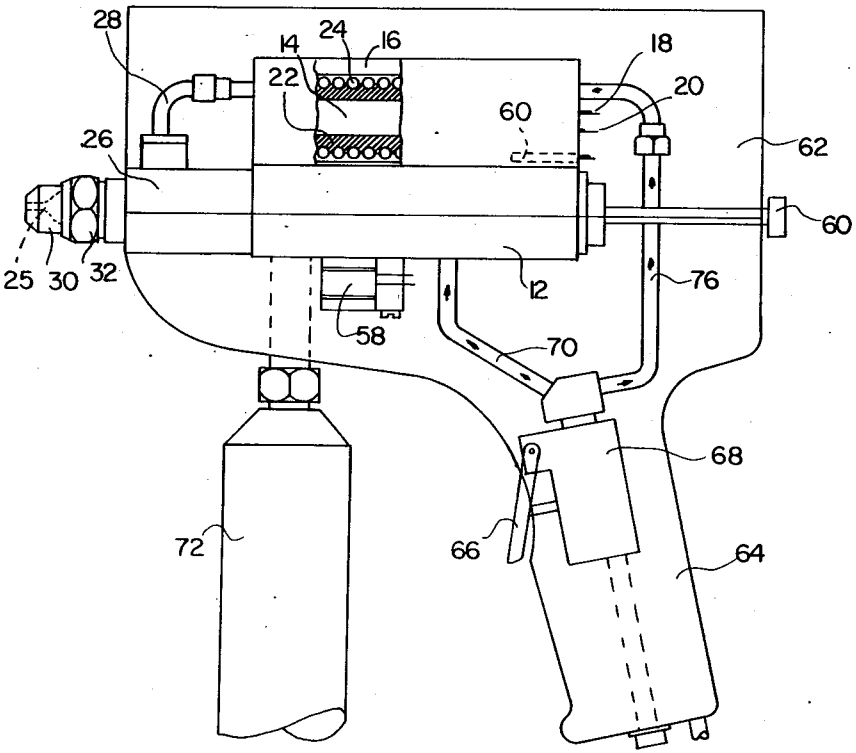
Figure 3:
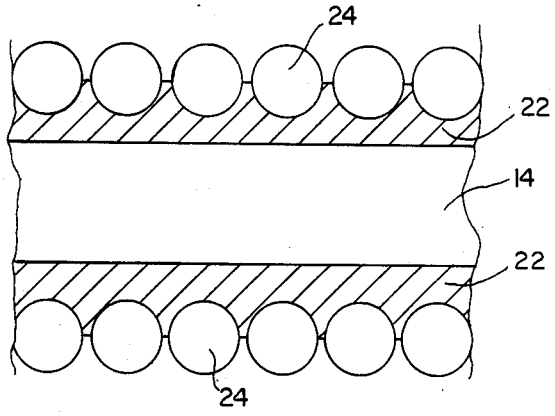

FIG. 2 a cross-section illustration of a manual extrusion gun,

FIG. 3 a section of FIG. 2, and FIG. 4 is an end view of the nozzle from the left as seen in FIG. 1.

In FIGS. 1 and 2 in each case a device is illustrated for spraying a hot melt glue onto an object to be glued. Hereby the illustration in FIG. 1 depicts an automatic extruder 10 with an extrusion casing 12. On one surface of the extrusion casing 12 lies a housing 16 having a heating cartridge 14. Hereby exists a heat conducting connection between housing 16 and the gun casing 12 in an adjustable range. The heating cartridge 14 which is to be supplied with electrical energy via connections 18 and 20 runs advantageously in the centre of the housing 16. The heating cartridge is in turn enclosed by a metal sheath 22. On the surface of the metal sheath a tube is located in spiral form, the tube being partly embedded in the metal sheath 22 (see FIG. 3).

A valve body 26 equipped with a nozzle 25 is located at the front end of extrusion casing.

The spiral tube's front end 28 which surrounds the heating cartridge 14 opens into the valve body 26. The nozzle 25 is located in the end of an air nozzle 30 which is connected to the valve housing 26 by means of a sleeve ring 32.

An axial drill hole 34 in the valve body 12 opens into the valve housing 26 in which a valve needle 36 is coaxially located for opening and closing adjustably an opening 38. The valve needle 36 comes from a piston 40 whose front face is powered by compressed air, thus causing an advance of piston 40 and hence valve needle 36 from the opening 38 against a force caused by a piston spring 42. Hereby the piston travel can be adjusted by means of an end-stop screw 44.

The melted hot melt glue is fed via connection 46 and the compressed air supply for advancing the piston 40 via opening 48. The areas of the inside of the gun fed with hot melt glue or air are separated by a section of the piston connecting rod 54 having seal 50, from which the valve needle extends.

Incidentally the distance between housing 16 and gun casing 12 can be set as required e.g. by means of distance washers, rings or laminas 77, thus permitting the required degree of heat transfer and hence heating up of gun casing 12.

The compressed air which is fed through tube 24 and thereby heated up is connected to a source of compressed air via connection 56. The glue is sprayed in a helical jet. This is created by feeding the the hot melt glue coaxially in air nozzle 30. Turbulence of the spray air in helical form is caused by five long flutes 78 running advantageously in nozzle 25 at the exit point of the hot melt glue, which ensures that spraying takes place to the desired degree. Hereby the long flutes can describe an angle of approx. 15° to the long axis of nozzle 25.

The temperature of the housing 16 is determined by the excellently illustrated heat detectors 58 and 60 in order to gain feedback on the temperature of the air upon leaving the spiral shaped fitted tube 24 or in the region of the connection to gun casing 12.

The design with regard to the gun casing and the housing containing the heat source is in the case of the manual extrusion gun in FIG. 2 equivalent, so that like components are marked with like references.

The forms of the various verisons differ in so far that the gun casing 12 and the housing 16 are enclosed by a common housing 62 which has a manual grip. A 3-way valve 68 actuated by an actuation component such as lever 66 in the manual grip, via which compressed air firstly in the gun casing 12 (connection 70) and secondly is fed to the spiral shaped fitted tube 24 around heating cartridge 14.

Further it can be seen from FIG. 2 that the heated and melted glue is fed via a well heated material hose 72.

It is also expressly pointed out that the heated air which flows over the tube section 28 is fed inside the valve housing 26 in order to heat this too to the required degree, so that heat is not drawn off of the melted glue itself to an unpermissible degree.

In FIG. 3 a section of the tube 24 which is partly embedded in metal sheath 22 is illustrated which together enclose the heating cartridge 14. It is recognisable that a good heat contact over a great area of the surface of tube 24 with the surface of metal sheath 22 is created, which ensures that the air flowing through the tube 24 is heated to a sufficient degree.

The metal sheath 22 can be heated up to 500° in the front area using a heating cartridge with a capacity of 350 Watts. In this instance the air fed to valve housing 26 has a temperature of 200°–220° Centigrade at a throughput of 180 to 200 l per minute. This temperature is sufficient that a hot melt glue can be sparyed via nozzle 25 in adequate quantity.

With higher pressures the air can be heated up to 300° Centigrade in the region of tube 28 by increasing the capacity of the heating cartridge 14 to e.g. 560 Watts. If the air is now expelled at a pressure of e.g. 4–4.5 bar, then the previously adjusted temperature will suffice in spite of the sudden temperature drop at the nozzle exit in order to spray hot melt glue to the required degree.

I claim:

1. A device for spraying hot-melt glue comprising an extrusion casing with an axial hole for passage of glue therethrough, said hole having a glue nozzle at one end thereof, a housing adjacent to and connected to said casing and containing a heating element, a longitudinal axis of said housing being spaced from and parallel to a longitudinal axis of said casing a sheath substantially surrounding said element, a helical tube substantially surrounding and at least partially embedded in said sheath, said tube leading to an air nozzle which substantially surrounds said glue nozzle, a first compressed air inlet connected to said tube at a point remote from said air nozzle, and a glue inlet connected to said hole, whereby compressed air entering said first inlet is heated by said element while in said tube and heat transfer between said casing and said heating element is controlled.

2. The device of claim 1 wherein said means comprises washers, rings, and/or laminas at least partially located between said casing and said housing.

3. The device of claim 1 wherein said element is substantically cylindrical.

4. The device of claim 1 further comprising a piston in said hole adapted for reciprocal movement therein, a needle in said hole adapted for reciprocal motion between a closed position, wherein said needle seats in a glue valve and prevents flow of said glue, and an open position, wherein said needle is withdrawn from said valve and flow of said glue is permitted, said reciprocal motion of said needle being caused by corresponding movement of said piston, said piston being baised by biasing means toward said closed position, a second compressed air inlet communicating between a source of compressed air and the face of said piston opposite said biasing means, whereby introduction of said compressed air through said second air inlet causes said piston and said needle to move toward said open position.

5. The device of claim 4 wherein a three-way valve is provided which is adapted to direct the compressed air into said tube through said first compressed air inlet and/or into said hole through said second compressed air inlet.

6. The device of claim 1 wherein a plurality of flutes is provided in said glue nozzle, said air nozzle adjacent said flutes being at an angle of more than about 15° to the axis of said glue nozzle, whereby a helical spray pattern is obtained.

7. The device of claim 6 wherein there are five said flutes.

8. The device of claim 1 wherein said housing is heated at a distance from said casing and means for adjusting the distance between said casing and said housing whereby heat transfer between said casing and said heating element is controlled.

* * * * *